United States Patent [19]

Monte

[11] 4,194,571

[45] Mar. 25, 1980

[54] FIRE SUPPRESSION MECHANISM FOR MILITARY VEHICLES

[76] Inventor: Anthony J. Monte, 47660 Bluebird, Utica, Mich. 48087

[21] Appl. No.: 14,502

[22] Filed: Feb. 23, 1979

[51] Int. Cl.[2] ..... A62C 35/12

[52] U.S. Cl. ..... 169/61; 169/9; 169/62

[58] Field of Search ..... 169/9, 28, 54, 61, 62; 180/6.7, 9.2 C, 82 R, 103 R; 280/748

[56] References Cited

U.S. PATENT DOCUMENTS

| | | | |
|---|---|---|---|
| 2,856,010 | 10/1958 | Brill et al. | 169/9 |
| 3,401,750 | 9/1968 | Larsen | 169/62 X |
| 3,491,783 | 1/1970 | Linsalato | 222/402.16 X |
| 3,688,846 | 9/1972 | Lease | 169/62 X |
| 3,762,479 | 10/1973 | Fike, Sr. et al. | 169/62 X |
| 3,915,237 | 10/1975 | Rozniecki | 169/62 |
| 3,994,352 | 11/1976 | Siorek | 180/103 R X |

*Primary Examiner*—Allen N. Knowles

*Assistant Examiner*—Fred A. Silverberg

*Attorney, Agent, or Firm*—Nathan Edelberg; Robert P. Gibson; Peter A. Taucher

[57] ABSTRACT

There is disclosed a fire suppression mechanism for a military tracked vehicle. The mechanism includes a number of relatively small cylindrical pressure vessels, each having a floating piston that separates the respective cylinder into 2 chambers. Vaporizable liquid fire suppressant material (such as C Br $F_3$) occupies one chamber; an inert pressurized gas such as nitrogen occupies the other chamber. An electrically-controlled valve at one end of each cylinder can be remotely triggered open to enable fire suppressant vapor to be discharged from the cylinder under the driving force provided by the pressure of the inert gas; the floating piston shifts along the cylinder as the vapor is discharged from the cylinder toward the developing fireball within the vehicle. Each cylinder is oriented in a horizontal prone position at a central point in the vehicle.

4 Claims, 5 Drawing Figures

FIRE SUPPRESSION MECHANISM FOR MILITARY VEHICLES

The invention described herein may be manufactured, used, and licensed by or for the Government for governmental purposes without payment to me of any royalty thereon.

BACKGROUND AND SUMMARY OF THE INVENTION

U.S. Pat. No. 3,915,237 illustrates a fire suppressant system for use in a military vehicle. That system envisions one or more cylindrical pressure vessels arranged in upright orientations; the lower portion of each vessel is occupied by liquid fire suppressant material such as C Br $F_3$ (tradename Halon 1301). The space above the liquid surface is occupied by an inert driver gas under pressure. Discharge of the suppressant material is through a remotely-controlled valve at the lower end of the pressure vessel.

The patented suppressant system requires that the pressure vessel be oriented in a vertical attitude; otherwise the inert pressurized driver gas would be apt to pass through the discharge valve, leaving some or all of the liquid suppressant still in the vessel. The present invention is directed to a fire suppressant system in which each pressure vessel can be oriented in a horizontal prone position without undesired loss of the pressurized driver gas. Use of the vessel in a prone position is desirable in low silhouette vehicles where space in the vertical direction may be very limited.

The vessel can be reoriented from a vertical position to a prone position by arranging a floating piston between the liquid fire suppressant material and the driver gas. As the discharge valve is opened the force of the driver gas is applied to one face of the piston; the piston in turn transmits the force to the liquid fire suppressant material for its discharge through the open valve. The piston has a sealed sliding fit with the inner surface of the cylindrical pressure vessel such that the driver gas is prevented from reaching the discharge valve.

THE DRAWINGS

Figure 3:
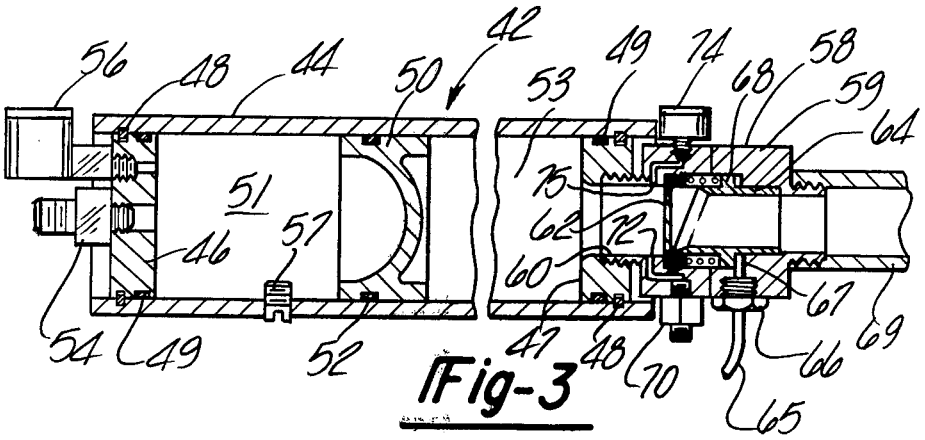
FIG. 3 is a sectional view of a pressure vessel and discharge valve usable in the FIG. 1 military tank for fire suppression purposes.
Figure 4:
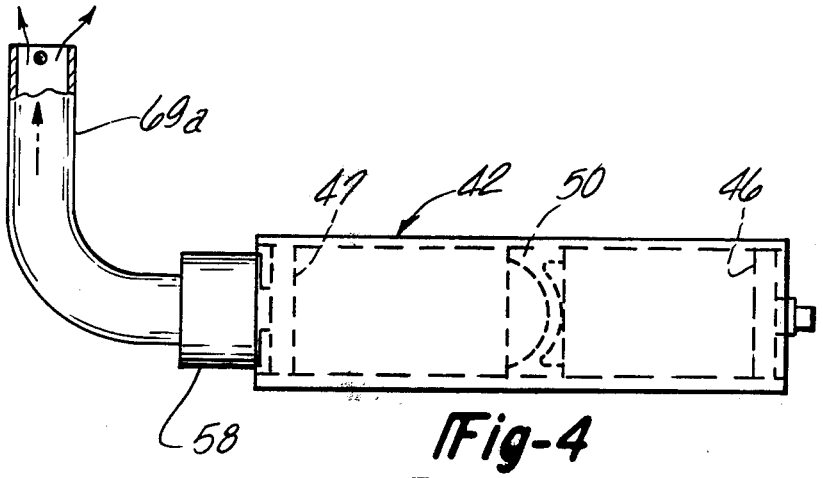

FIG. 4 illustrated a curved discharge tube usable with the FIG. 3 pressure vessel.

Figure 5:
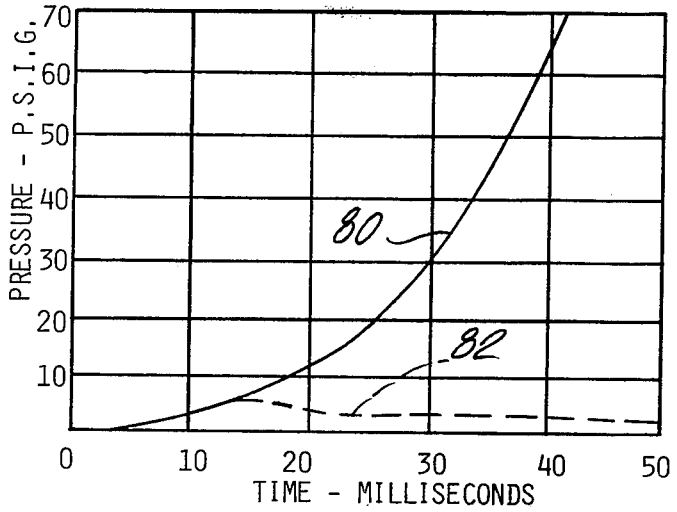

FIG. 5 is a pressure-time curve for an explosion-like fire of the type that would be treated with apparatus of the present invention.

Figure 1:
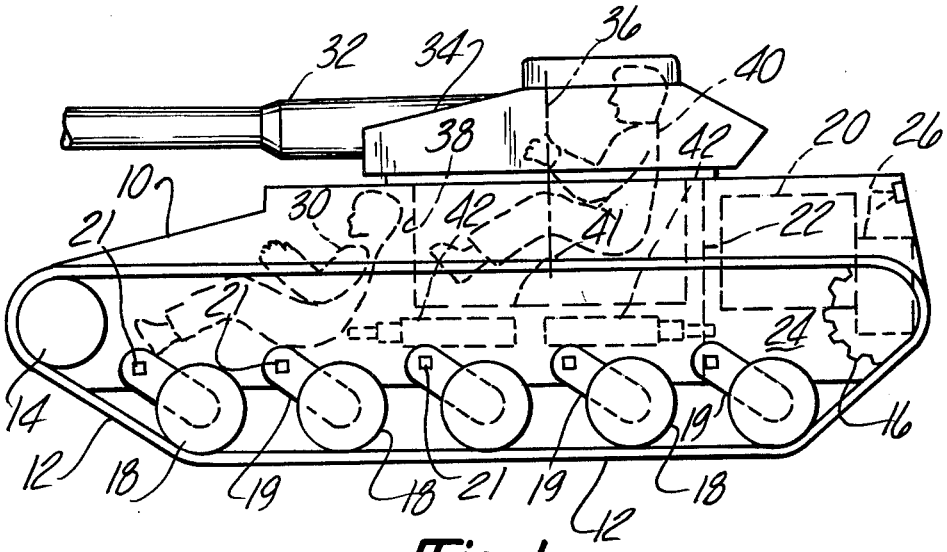
FIG. 1 is a side elevational view of a military tank utilizing fire suppressant mechanisms constructed according to this invention.
Figure 2:
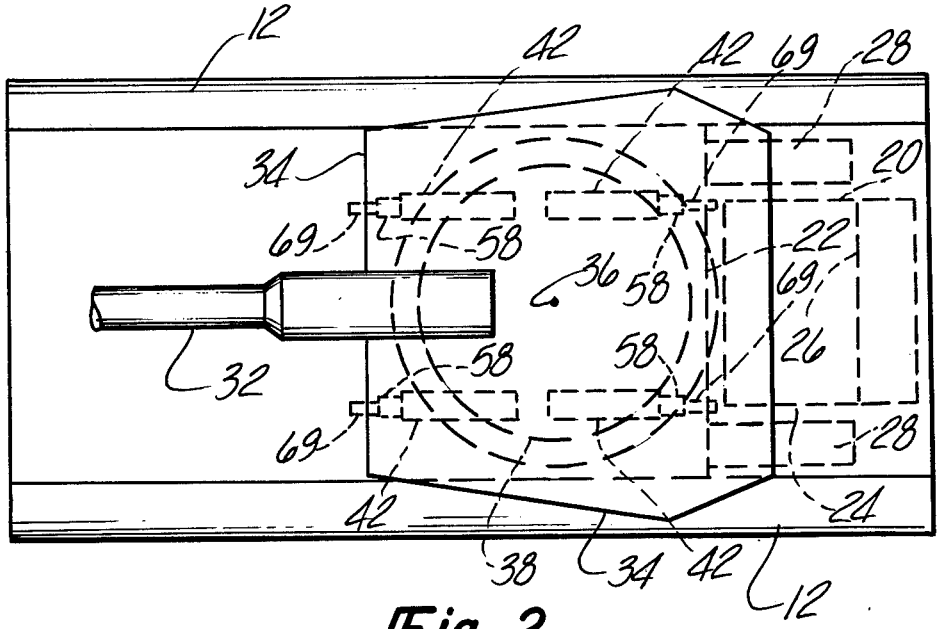
FIG. 2 is a top plan view of the FIG. 1 military tank.

There is shown in FIGS. 1 and 2 a low silhouette military tank comprising a hull 10 having an endless ground-engaged track 12 along each of its sides. Each track 12 is trained around a front idler wheel 14, a rear track-driver sprocket wheel 16, and five ground wheels 18. Each road wheel 18 is carried on a swingable road-arm 19 that is attached to a torsion bar 21 extending transversely through the hull to an anchorage at the opposite side wall of the hull. Propulsion force is provided by an internal combustion engine 20 located behind a fire wall 22 in an engine compartment 24. A transmission 26 selectively transmits engine drive shaft power to the sprocket wheels 16 to provide either forward vehicle motion, or reverse motion, or turn action. Fuel (gasoline or diesel oil) is supplied to the engine from separate fuel tanks 28 located within the engine compartment. The driver of the vehicle, designated by numeral 30, would occupy a position in the forward section of the hull.

The main gun 32 for the vehicle is mounted on a turret 34 that is supported on the hull for rotation around a central vertical axis 36. Depending from the turret into the hull interior is a basket 38 that provides space for the gunner, designated by number 40. Bottom wall 41 of basket 38 is spaced a slight distance above the subjacent torsion bars 21, thereby leaving a clearance space for accommodating a number of cylindrical fire-suppressant pressure vessels 42. As illustratively shown in FIG. 2, there are four cylindrical pressure vessels 42, each arranged in a prone position partially underlying basket 38; each vessel 42 is suitably mounted in a fixed position within the hull by means of non-illustrated brackets. The two frontmost pressure vessels 42 have control valves at their front ends for discharge of fire-suppressant vapor into the forward space occupied by driver 30. The two rearmost pressure vessels 42 have control valves at their rear ends for discharge of fire-suppressant vapor through fire wall 22 into the engine compartment 24. The rearmost pressure vessels are oriented so that their discharge pipes 69 discharge into the spaces just inboard from fuel tanks 28 (and alongside the sides of the engine) where a fireball from an enemy projectile is most likely to be generated. The two rearmost pressure vessels are oriented to control or extinguish fires within the engine compartment without occupying space within the engine compartment. In many cases space within the engine compartment is very limited.

Each of the four pressure vessels 42 may be constructed as shown in FIG. 3. As there shown, the pressure vessel comprises an elongated cylindrical tube 44 closed at its opposite ends by means of end caps or walls 46 and 47. Each end wall is retained against outward explosion by a split-ring retainer 48; the joint between the end wall and cylindrical tube is sealed by an O-ring 49.

The interior space within the pressure vessel is subdivided into two compartments 51 and 53 by means of a floating piston 50 having one or more endless seals 52 slidably engaging the inner surface of tube 44. The pressure vessel structure thus far described may be similar to the structure of a commercial accumulator marketed by American Bosch Co. of Springfield, Massachusetts under its designation "ACC series 2000". Such an accumulator has a length of about twenty six inches and an external diameter slightly less than six inches; materials and wall thicknesses are such that the commercial unit can safely withstand internal pressure up to about 3000 p.s.i., with a 4 to 1 safety factor. When used for fire suppression purposes the vessel is subjected to internal pressures in the neighborhood of 1000 p.s.i.

As shown in FIG. 3, end wall 46 mounts a charging valve 54 which has an exposed threaded pipe section for connection with nitrogen supply tubing (not shown). Valve 54 is a check valve that opens to permit pressurized gas to flow into chamber 51, but then closes to prevent backflow out of the chamber. A pressure gage 56 is connected to wall 46 to sense and indicate the pressure in chamber 51 during and after the nitrogen-charging operation.

End wall 47 mounts an electrically-controlled valve 58 that may be constructed similarly to the explosive squib-actuated valve shown in U.S. Pat. No. 3,491,783 issued on Jan. 27, 1970 to O. L. Linsalato; a solenoid-operated valve could also be used. Valve 58 shown in the attached drawings comprises a multi-piece housing 59 defining a flow passage 60 that is normally closed by a metallic diaphragm 62 suitably clamped within the housing. A tubular spring-retracted cutter element 64 is slidably disposed within the housing to normally occupy a retracted position displaced to the right of diaphragm 62. However when an electrical signal is fed through electrical lead wiring 65 to an explosive squib 66 the resultant explosion generated in annular space 67 acts on flange 68 of the cutter element, to thus drive the cutter element through diaphragm 62, thereby enabling pressurized fluid to flow from chamber 53 through passage 60 and into a connected discharge pipe 69. Depending on the orientation of the pressure vessel within the vehicle, the pressurized vapor is discharged either into the rear engine compartment 24 (FIGS. 1 and 2) or the forward driver space.

Chamber 53 is initially charged with a vaporizable liquid fire-suppressant material, as for example $CF_3Br$ marketed under the tradename Halon 1301. Relatively high pressures on the order of 1000 p.s.i. are used. The initial charging operation is accomplished by pumping liquid fire-suppressant material from a remote source through a check valve 70 and passage 72. Pressure within chamber 53 is detected and registered by means of a pressure gage 74 that communicates with the chamber through a small passage 75.

The sequence of charging chambers 53 and 51 in the pressure vessel includes the initial step of charging a predetermined quantity of liquid fire-suppressant material into chamber 53. The liquid quantity may be controlled either by pumping the material from a container having a known volume, or by locating the supply container on a weighing scale and noting the weight loss, or by pumping the material into chambers 53 until gage 74 registers a predetermined pressure known to correspond to a desired quantity of liquid fire-suppressant material. A stop 57 may be located in tube 44 to limit the quantity of liquid introduced to chamber 53. During the charging operation the subdivider piston 50 is automatically displaced leftwardly to a position engaged with stop 57, thereby establishing the quantity of liquid in chamber 53.

After liquid has been charged into chamber 53 nitrogen or other pressurized gas is charged into chamber 51 through valve 54. Piston 50 is automatically displaced rightwardly to exert a pressurizing force on the liquid in chamber 53. The pressures in chambers 51 and 53 should be approximately the same, as for example approximately 1000 p.s.i. Pressures are sensed by gages 56 and 74.

The four fire-suppressant vessels 42 may be charged before installation thereof into the vehicle. However, it is also possible to charge or recharge the vessels after installation into the vehicle. Clearance conditions between the bottom wall 41 of basket 42 are so restricted that in most cases access openings must be formed in wall 41 to facilitate the charging operation.

Each valve 58 may be automatically controlled or triggered by electric signals generated by infrared light emissions associated with the developing fireball produced by enemy projectiles fired into the vehicle, either in the engine compartment or driver space. Additionally or alternately, the driver's station may be equipped with one or more manual push-button switches for delivering control signals to selected ones of the valve control squibs 66 in accordance with the location of the fireball in the vehicle. A suitable automatic infrared-responsive signal generator is manufactured by Santa Barbara Research Center under its designation PM-34. One or more such optically-responsive generators may be located in the engine compartment to optically respond to the developing fireball generated by enemy action. Amplified electrical output from the generator is delivered through lead wiring 65 (FIG. 3) to thus open valve 58, thereby permitting pressurized fire suppressant to be delivered to the fireball area. Each delivery pipe 69 may be provided with a splitter rod, as shown at 56 in aforementioned U.S. Pat. No. 3,915,237.

The principal advantage of the fire-suppressant system shown in the attached drawings is its optimum use of available space in a low silhouette military vehicle. The four principal components, referenced by numeral 42, occupy only about six inches in the vertical dimension. Also, the components are located outside the engine compartment where space is quite limited. The prone disposition of the four fire-suppressant mechanisms 42 enables the different mechanisms to discharge suppressant in different directions, i.e. to the engine compartment and/or to the driver space. The fire-suppressant devices are shown as being oriented parallel to the longitudinal axis of the vehicle. However, it is possible to orient selected ones of the pressure vessels 42 at acute angles to the vehicle axis, when space considerations or equipment locations so require. FIG. 2 shows four pressure vessels 42. It is contemplated that lesser or greater numbers of the pressure vessels can be employed, the principal aim being to employ at least one vessel discharging rearwardly into the engine compartment and one vessel discharging forwardly toward the space occupied by the driver.

Fireballs generated in military vehicles often expand in near explosion-like fashion. To illustrate, there is shown in FIG. 5 a curve 80 depicting the pressure increase associated with a fireball produced by ignition of fuel contained in the vehicle fuel tank. The pressure wave expands at a near explosion rate into the interior space within the vehicle. However, if the fireball can be extinguished within a few milliseconds after the onset of ignition the pressure can be controlled without loss of life; curve 82 shows pressure conditions achievable with a prompt suppression of the fireball. It is preferred that the fireball be extinguished within no more than about 100 milliseconds from the initial fireball generation time. Short extinguishment time requires quick delivery of the suppressant vapor. In turn, quick delivery of the pressurized fire-suppressant vapor toward the fireball is promoted by a high charging pressure in the pressure vessel, and/or by a straight-line discharge of the vapor out of the pressure vessel, and/or by the absence of flow obstructions after the suppressant vapor leaves the pressure vessel. In the illustrated system the fire-suppressant charging pressure can be comparatively high because of the presence of the floating piston 50; the piston separates the suppressant from the pressurized driver gas, thus avoiding a problem of solubility of nitrogen in the fire-suppressant, which would lower the effective discharge pressure and contribute to dilution of the fire-suppressant vapor with nitrogen bubbles. The prone position of the pressure vessels is advantageous in that the fire-suppressant vapor is discharged axially without change of direction after leaving chamber 53; the straight-line discharge avoids certain disadvantageous pipe bend frictional effects experienced with conventional upright pressure vessels, as discussed in abovementioned U.S. Pat. No. 3,915,237.

It will be noted from FIGS. 1 and 2 of the drawings that fire-suppressant vessels 42 are located approximately midway between the front and rear ends of the vehicle. Such a location is believed to be advantageous in minimizing the total wiring length needed for a complete system, as well as in reducing the space needed for gas pressurization of the vessels; single access openings can be provided in basket bottom wall 41 to service two pressure cylinders. The front and rear pressure vessels can be slightly offset in the lateral direction if necessary for easy access to the adjacent ends of the cylindrical vessels.

In certain vehicles it may be desired to have a capability for directing pressurized fire-suppressant vapor to an ammunition storage area in the turret and/or the turret space occupied by the gunner (or commander in larger tanks). The described prone dispositon of the fire-suppressant vessels is not conducive to straight-line discharge of vapor into the turret space. However, with some sacrifice in discharge time it is possible to use a curved discharge tube structure that provides some measure of protection. The essential features of such an arrangement are shown at 69*a* in attached FIG. 4.

I wish it to be understood that I do not desire to be limited to the exact details of construction shown and described for obvious modifications will occur to a person skilled in the art.

I claim:

1. In a tracked military vehicle comprising a hull subdivided into a rear engine compartment and a forward driver compartment, a turret rotatably mounted on a central portion of the hull upper wall and having a basket depending therefrom into the hull interior space, the hull having a bottom wall spaced below the basket to define an intervening clearance space; the improvement comprising fire suppressant means disposed in the aforementioned clearance space, said fire suppressant means comprising first horizontally-oriented cylinder means underlying the rear portion of the basket and second horizontal cylinder means underlying the front portion of the basket, each said cylinder means comprising a cylindrical pressure vessel having end walls and an intermediate floating piston, a flashable vapor fire suppressant material changed into the space between one end wall and the piston, an inert pressurized gas charged into the space between the other end wall and said piston, an electrically-operated valve mounted on said one end wall of each pressure vessel to control the escape of pressurized suppressant from the vessel; the cylinder means being oriented so that the first cylinder means discharges suppressant to the engine compartment and the second cylinder means discharges suppressant to the driver compartment.

2. The improvement of claim 1 wherein the first cylinder means includes two horizontally-oriented cylinders extending generally parallel to the longitudinal axis of the vehicle.

3. The improvement of claim 1 wherein each said cylindrical pressure vessel mounts a first pressure gage responsive to the suppressant pressure and a second pressure gage responsive to the inert gas pressure.

4. The improvement of claim 1 wherein each said pressure vessel has an outside length of about twenty six inches and an outside diameter of about six inches.

* * * * *